United States Patent [19]

Louther, Jr.

[11] 4,110,946

[45] Sep. 5, 1978

[54] SPLIT BACK FURNITURE ARTICLE AND METHOD OF ASSEMBLY

[75] Inventor: William P. Louther, Jr., Madison, Wis.

[73] Assignee: AFP Corporation, Madison, Wis.

[21] Appl. No.: 824,291

[22] Filed: Aug. 15, 1977

[51] Int. Cl.[2] ..... A47B 47/00; E04C 3/10

[52] U.S. Cl. ..... 52/223 R; 52/741; 312/264; 312/257 R

[58] Field of Search ..... 52/222, 495, 496, 223 R, 52/741; 312/264, 257 R

[56] References Cited

U.S. PATENT DOCUMENTS

| | | | |
|---|---|---|---|
| 290,991 | 12/1883 | Lee | 52/222 X |
| 591,275 | 10/1897 | Horn | 312/264 |
| 2,311,951 | 2/1943 | Marshall | 52/496 X |
| 2,615,211 | 10/1952 | Gardner | 52/495 |
| 2,837,393 | 6/1958 | Sitler | 312/257 R |
| 3,077,426 | 2/1963 | Johnston | 52/747 X |
| 3,338,627 | 8/1967 | Frank | 297/153 |

FOREIGN PATENT DOCUMENTS

| | | | |
|---|---|---|---|
| 1,842 of | 1912 | United Kingdom | 52/747 |
| 23,002 of | 1914 | United Kingdom | 312/264 |

*Primary Examiner*—Alfred C. Perham

*Attorney, Agent, or Firm*—Lowe, Kokjer, Kircher, Wharton & Bowman

[57] ABSTRACT

A furniture article such as a bookshelf unit has a pair of back panels which are arranged edge to edge in extension between upright side members. The outer edges of the panels are received in grooves formed in the sides. The combined width of the panels is greater than the distance between the side members so that the panels initially overlap at their inner edges. The panels are displaced to position their inner edges in butting engagement and are then snapped into a common plane with the edges remaining butted together to retain the panels under compression in the assembled condition.

9 Claims, 5 Drawing Figures

SPLIT BACK FURNITURE ARTICLE AND METHOD OF ASSEMBLY

BACKGROUND AND SUMMARY OF THE INVENTION

This invention relates to an improved furniture article and also to a method of assembling the same.

Furniture which is shipped to retailers in disassembled form is know in the trade as "knockdown" furniture. The individual pieces are removed from the shipping carton and assembled for display or use. Various types of knockdown furniture items are commonly handled in this manner, including book shelves, dressers, and cabinets such as those enclosing television and stereo equipment.

At present, the assembly of knockdown furniture is a difficult and time consuming task. Complex and expensive fasteners are required to attach the various components to one another, and the stability of the assembled unit is often lacking. Further, bookshelves and the like usually have a wide back panel which requires a large shipping carton and which takes up considerable room during transport. Attachment of this large back panel to the side supports in a stable manner has also presented a problem.

It is an object of the present invention to provide an improved knockdown type furniture article and a quick and easy method of assembling same.

One object of the invention is achieved by providing a furniture article having a pair of back panel sections which are butted together at the edges and firmly held under compression in the assembled position. This split back structure not only facilitates assembly of the article but also stabilizes the back panel and the entire assembly due to the tight edge to edge fit of the panel sections against one another. Equally important, the panel sections are each only half as wide as a unitary back panel would be, and the size of the carton required to ship the disassembled unit is reduced accordingly.

A further object of the invention is achieved by providing a furniture article of the character described in which the outer edges of the back panels are retained in grooves formed in the side supports. Again, this arrangement facilitates the assembly procedure and adds to the sturdiness of the assembled unit while eliminating the need for complicated fastening devices.

Yet another object of the invention is to provide an article and method of assembly which is suitable for various types of knockdown furniture items.

An additional object of the invention is to provide a furniture article of the character described which is durable, economical, and attractive in appearance.

Other and further objects of the invention, together with the features of novelty appurtenant thereto will appear in the course of the following description.

DETAILED DESCRIPTION OF THE INVENTION

In the accompanying drawing which form a part of the specification and are to be read in conjunction therewith, and in which like reference numerals are employed to indicate like parts in the various views.

Figure 1:
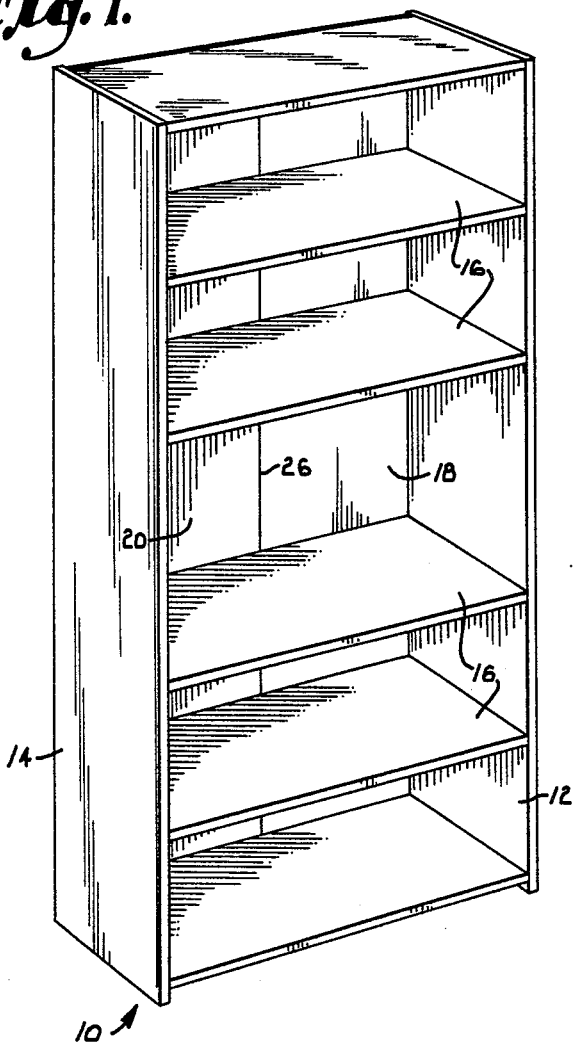
FIG. 1 is a perspective view of a bookshelf unit constructed and assembled in accordance with the present invention.

For purposes of illustrating the principles of the invention, the drawing shows an article of furniture in the form of a bookshelf unit 10. The main support for the unit is provided by a pair of upright sides 12 and 14 which are spaced apart and parallel to one another. A plurality of horizontal shelves 16 extend between the sides 12 and 14, being secured thereto in any suitable manner such as by clips or the like (not shown). The sides 12 and 14 and shelves 16 are preferably constructed from relatively hard composition board members which are provided with an attractive finish such as a simulated walnut finish, for example. The composition board is of the type in which the interior of the board is less dense than that portion immediately adjacent, and thus more subject to compressive deformation. This characteristic of compressive deformability of the material when the surface has been penetrated plays a part in my invention, as will be seen.

The back section of the bookshelf is formed by a pair of flat rectangular panels 18 and 20 which may be particle board, or any other suitable material having adequate strength and rigidity. The panels are much thinner than sides 12 and 14. Moreover, they are constructed of a more dense material (known to the trade as hardboard) than the interior of the boards of which the sides are formed. The length of each panel 18 and 20 is substantially the same as the length of sides 12 and 14, while each panel has a width slightly greater than half the distance between the sides, as will be explained in more detail. The edges of panels 18 and 20 are blunt.

The flat inside surfaces of sides 12 and 14 are provided with respective grooves 22 and 24 cut into the composition board and (FIG. 2) which extend the entire length of the sides. Each groove is located adjacent to the rear edge of its side. The grooves 22 and 24 are sized to closely receive the outer edges of back panels 18 and 20, respectively.

To assemble the bookshelf unit 10, shelves 16 are initially connected to extend between sides 12 and 14, thus securing the sides apart from and parallel to one another. It is noted that the shelves terminate at the forward edges of grooves 22 and 24 so that the grooves remain open along there entire lengths.

Figure 3:
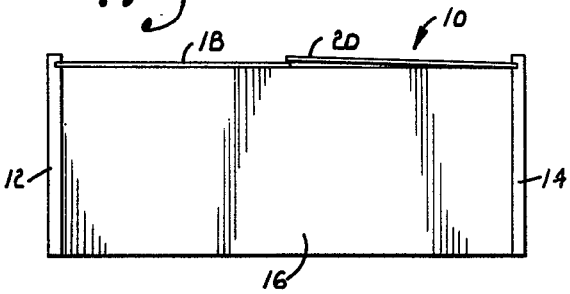
FIG. 3 is an end elevational view taken from the right end of the bookshelf unit shown in FIG. 2 but in a more advanced stage of assembly with the second panel slid fully into position overlapping the inner edge of the first panel.
Figure 4:
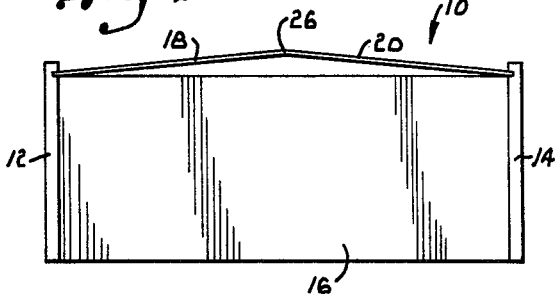
FIG. 4 is an end view similar to that of FIG. 3 but with the unit in a still more advance stage of assembly wherein the back panels are displaced to position their inner edges in butting engagement.
Figure 5:
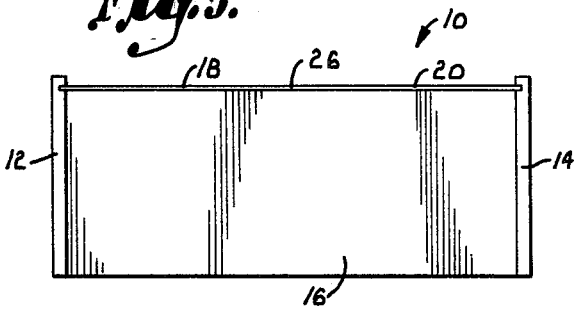
FIG. 5 is an end view similar to those of FIGS. 3 and 4 but showing the back panels in the fully assembled condition.
Figure 2:
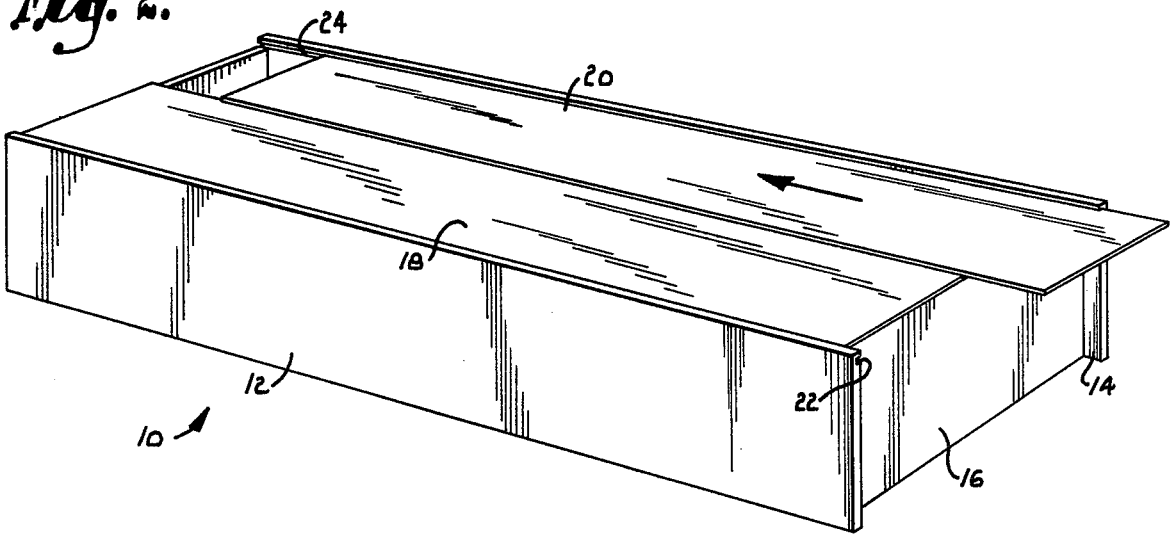
FIG. 2 is a perspective view showing the bookshelf unit lying face down in a partially assembled state, with one back panel being slid in the direction of the arrow into a position overlapping the inner edge of the other back panel.

The partially assembled bookshelf is placed face down with the forward edges of sides 12 and 14 resting on a supporting surface as shown in FIG. 2. Next, the outer edge of panel 18 is slid into groove 22 to connect the panel with side 12. The outer edge of the other panel 20 is then slid into groove 24. Since the combined width of panels 18 and 20 is greater than the distance between sides 12 and 14 (including the combined depth of grooves 22 and 24), the inner edges of the panels overlap slightly, with panel 20 resting on top of panel 18 as shown in FIG. 3. However, due to the limited flexibility of panels 18 and 20 and the small amount of play provided by grooves 22 and 24, the panels may be displaced such that their edges are raised sufficiently to butt against one another in the position of FIG. 4. Finally, the center joint or seam area 26 where the panels butt together is pressed downwardly. Due to the relative softness of the material in the base of the grooves as compared to that of the edges of the panels 18 and 20, as the pressure continues to be applied the edges in the grooves will compressively deform the material sufficiently as to permit the panels to assume a planar relationship as shown in FIG. 5. The deformation is partially a resilient deformation so that when the panels are co-planar, there is pressure applied at the abutting edges, tending to hold them firmly in position.

As a result of the dimensions and arrangement of the components and composition of the materials, panels 18 and 20 are compressed when in the assembled position and are firmly held under compression with their inner edges remaining butted against one another. The panels extend between sides 12 and 14 in a common plane and with their forward surfaces contacting the rear edges of shelves 16. The pressure exerted by the compressed panels 18 and 20 makes the seam 26 nearly invisible and thus enhances the attractiveness of the finished article.

As an example of dimensions that have proven successful, the sides 12 and 14 may be spaced apart a distance of 28 inches with the grooves 22 and 24 each having a depth of 3/16 inch. Thus the total distance between the bases of the grooves is 28⅜ inches. Each panel 18 and 20 may be 14¼ inches wide so that the combined width of the panels is 28½ inches. In the FIG. 3 position, the panels will overlap ⅛ inch, and their inner edges will butt against one another in the FIG. 4 position if raised slightly less than 1½ inches, assuming little or no bending of the panels. When the panels are subsequently snapped into the lock position of FIG. 5, they will each be compressed approximately 1/16 inch. As a consequence, the panels apply enough force to maintain them firmly locked in the assembled position. It is noted that the forceful butting of the panel edges at seam 26 enhances the stability of the central area of the back section, thereby adding to the sturdiness of the structure.

Although a bookshelf unit has been illustrated and described for purposes of disclosing the principles of the invention, it is to be understood that the split back construction and method of assembly is equally applicable to various other types of furniture articles. For example, it is contemplated that television and stereo cabinets will be constructed in accordance with the invention, and that the cords associated with the equipment will extend through the seam 26, thus eliminating the need to drill a hole in the back panel. It is also pointed out that each panel 18 and 20 has a width only about half as great as would be the case if the back panel were a unitary member. Consequently, the disassembled unit may be shipped in a relatively narrow carton which occupies little room during transport.

From the foregoing it will be seen that this invention is now well adapted to attain all the ends and objects hereinabove set forth, together with other advantages which are obvious and which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawing is to be interpreted as illustrative and not in a limiting sense.

Having thus described the invention, I claim:

1. A furniture article comprising:

first and second frame members spaced apart from one another;

a first flat panel having opposite edges;

means for connecting one edge of said first panel to said first frame member with the other panel edge located between said first and second frame members;

a second flat panel having opposite edges; and means for connecting one edge of said second panel to said second frame member with the other edge of said second panel butting against said other edge of the first panel, the combined undeformed dimension of said first and second panels between the edges thereof being greater than the distance between said frame members, whereby when said other edges of said panels butt against one another the panels are held under compression in extension between said frame members.

2. An article as set forth in claim 1, wherein the means for connecting one edge of said first panel comprises a groove formed in said first frame member and sized to closely receive said one edge of the first panel.

3. An article as set forth in claim 2, wherein the means for connecting one edge of said second panel comprises a groove formed in said second frame member and sized to closely receive said one edge of the second panel.

4. A method of assembling a furniture article from first and second frame members and first and second flat panels each having opposite edges, said method comprising the steps of:

securing said first and second frame members in spaced apart relation with the distance therebetween less than the combined dimension of said first and second panels between said edges thereof;

connecting one edge of said first panel to said first frame member with the other edge of said first panel located between said first and second frame members;

connecting one edge of said second panel to said second frame member with the other edge of said second panel overlapping said other edge of the first panel;

displacing at least one of said first and second panels in a manner to position said other edges of the panels in butting engagement against one another; and positioning said panels in a substantially common plane with said other edges remaining in butting engagement to hold said panels under compression in extension between said frame members.

5. A method as set forth in claim 4, wherein said displacing step comprises displacing both of said first and second panels out of said common plane in a manner to position said other edges in butting engagement.

6. A method as set forth in claim 4, wherein said second frame member has a groove formed therein of a size to closely receive said one edge of said second panel and the step of connecting one edge of said second panel comprises inserting said one edge into said groove.

7. A method as set forth in claim 6, wherein said first frame member has a groove formed therein of a size to closely receive said one edge of said first panel and the step of connecting one edge of said first panel comprises inserting said one edge into said groove of the first frame member.

8. An article as set forth in claim 3, wherein the portions of said first and second frame members adjacent said grooves are formed of material which is softer than the material on the edges of said first and second panels.

9. An article as set forth in claim 8, wherein said portions of said first and second frame members are compressively and resiliently deformed when said other edges of said panels butt against one other.

* * * * *